US010964471B2

(12) United States Patent
Eriksson et al.

(10) Patent No.: US 10,964,471 B2
(45) Date of Patent: Mar. 30, 2021

(54) HIGH VOLTAGE CABLE FOR A WINDING AND ELECTROMAGNETIC INDUCTION DEVICE COMPRISING THE SAME

(71) Applicant: ABB Power Grids Switzerland AG, Baden (CH)

(72) Inventors: Goran Eriksson, Västerås (SE); Manoj Pradhan, Bålsta (SE); Torbjörn Wass, Västerås (SE)

(73) Assignee: ABB POWER GRIDS SWITZERLAND AG, Baden (CH)

( * ) Notice: Subject to any disclaimer, the term of this patent is extended or adjusted under 35 U.S.C. 154(b) by 49 days.

(21) Appl. No.: 16/324,247

(22) PCT Filed: Jun. 28, 2017

(86) PCT No.: PCT/EP2017/065992

§ 371 (c)(1),
(2) Date: Feb. 8, 2019

(87) PCT Pub. No.: WO2018/028874

PCT Pub. Date: Feb. 15, 2018

(65) Prior Publication Data

US 2020/0194164 A1 Jun. 18, 2020

(30) Foreign Application Priority Data

Aug. 9, 2016 (EP) ..... 16183290

(51) Int. Cl.
*H01F 27/32* (2006.01)
*H01F 27/28* (2006.01)
(Continued)

(52) U.S. Cl.
CPC ..... *H01F 27/2885* (2013.01); *H01F 27/24* (2013.01); *H01F 27/2823* (2013.01); *H01F 1/42* (2013.01); *H01F 1/44* (2013.01)

(58) Field of Classification Search
USPC ..... 336/84 R, 186
See application file for complete search history.

(56) References Cited

U.S. PATENT DOCUMENTS 4,323,870 A 4/1982 Moritz et al.
4,383,225 A 5/1983 Mayer
(Continued)

FOREIGN PATENT DOCUMENTS

CN 202720954 U 2/2013
CN 102792388 B 3/2015
(Continued)

OTHER PUBLICATIONS

English translation of JP2011078232A (Year: 2011).*
(Continued)

*Primary Examiner* — Ronald Hinson
(74) *Attorney, Agent, or Firm* — Sage Patent Group

(57) ABSTRACT

The present disclosure relates to a cable for a high voltage winding of an electromagnetic induction device. The cable includes a conductor having a width w, and a shield arranged around at least a portion of the conductor, wherein in any cross-section of the conductor the conductor has rounded corners with a radius r in the range $w/5<r\leq w/3$. A high voltage electromagnetic induction device having a cable forming a high voltage winding is also disclosed.

20 Claims, 4 Drawing Sheets

(51) Int. Cl.

| | |
|---|---|
| ***H01F 27/24*** | (2006.01) |
| *H01F 1/42* | (2006.01) |
| *H01F 1/44* | (2006.01) |

(56) References Cited

U.S. PATENT DOCUMENTS

| | | | | |
|---|---|---|---|---|
| 5,545,853 | A * | 8/1996 | Hildreth | H01B 7/295 174/120 R |
| 2010/0294531 | A1 | 11/2010 | Wefers | |
| 2011/0316662 | A1 | 12/2011 | Pregartner et al. | |
| 2012/0267205 | A1* | 10/2012 | Barker | F16F 9/532 188/267.2 |
| 2014/0035712 | A1* | 2/2014 | Thornkvist | H01F 27/288 336/175 |
| 2014/0360756 | A1* | 12/2014 | Honda | H01B 3/308 174/119 C |
| 2016/0104567 | A1 | 4/2016 | Doljack | |

FOREIGN PATENT DOCUMENTS

| | | | |
|---|---|---|---|
| CN | 103594156 | B | 3/2016 |
| EP | 0409479 | A1 | 1/1991 |
| EP | 1016100 | | 7/2000 |
| EP | 1016100 | A1 | 7/2000 |
| EP | 1453068 | A1 | 9/2004 |
| JP | 2011100904 | A | 5/2011 |
| WO | 2012136754 | A1 | 10/2012 |

OTHER PUBLICATIONS

European Search Report Application No. EP 16 18 3290 Completed: Jan. 26, 2017;dated Feb. 7, 2017 11 pages.

International Preliminary Report on Patentability Application No. PCT/EP2017/065992 dated Dec. 3, 2018 10 pages.

International Search Report and Written Opinion of the International Searching Authority Application No. PCT/EP2017/065992 Completed: Sep. 14, 2017; dated Oct. 17, 2017 16 pages.

Written Opinion of the International Searching Authority Application No. PCT/EP2017/065992 dated Jul. 19, 2018 5 pages.

Chinese Office Action and Search Report, CN Application No. 2017800490750, dated Aug. 9, 2020, 7 pages.

* cited by examiner

HIGH VOLTAGE CABLE FOR A WINDING AND ELECTROMAGNETIC INDUCTION DEVICE COMPRISING THE SAME

TECHNICAL FIELD

The present disclosure generally relates to high voltage equipment. In particular, it relates to a cable for a high voltage winding of an electromagnetic device.

BACKGROUND

Electromagnetic induction devices, such as transformers and reactors, are used in power systems for voltage level control. Hereto, a transformer is an electromagnetic induction device used to step up and step down voltage in electric power systems in order to generate, transmit and utilize electrical power in a cost effective manner. In a more generic sense a transformer has two main parts, a magnetic circuit, the core, made of e.g. laminated iron or steel and an electrical circuit, windings, usually made of aluminum or copper wire.

Larger transformer used in electrical power networks are generally designed with high efficiency and with a set of stringent operational criteria e.g. dielectric, thermal, mechanical and acoustic criteria. Due to continuously increasing power handling capacity, i.e. power and voltage rating, of transformers, transformer design faces more and more constraints.

Modern practice of design of transformers involves inter alia the balance of use of materials in core and winding, and losses. Due to the large amount of power handled by a large power transformer and due to long service life, typically 40 years, any improvement in reduction of losses would be appreciable, if it can be justified by the cost.

Power loss in transformers due to load currents is a large part of the total losses. The load loss (LL) consists of perceivably three different types of losses based on their origin, i) the I2R losses due to inherent resistance of winding conductors, also called DC loss, ii) the eddy current loss (ECL) in the windings due to the time-varying magnetic field created by the load current in all winding conductors, the leakage field and iii) the stray losses, i.e. ECL in other structural parts of the transformer due to the leakage field.

Current solutions for reducing eddy current losses include multi-strand continuously transposed cables (CTC). These cables require stronger copper in order to be able to handle short circuits in high voltage applications. Moreover, the manufacturing of CTC cables having a plurality of sufficiently thin and transposed strands is a very expensive process and requires gluing and insulation of the strands by means of epoxy. The material cost of high voltage inductive devices hence increase tremendously.

Another approach is disclosed in WO2012136754. This document discloses a cable for a winding of an electromagnetic induction device. The cable comprises a conductor, and a layer comprising a magnetic material having a relative magnetic permeability in the range 2 to 100000, wherein the layer at least party surrounds the conductor. Eddy current losses may thereby be reduced.

U.S. Pat. No. 5,545,853 discloses a surge-protected cable for use in the wire leads and wire-wound stators of electrical motors. The cable is of the "filter line" type and reduces failures in the stator windings of variable frequency drive (VFD) motors by attenuating peak voltages and transient voltage spikes. The "filter line" type of cable insulation prevents "dirty" power from unabated travel along the axis.

The filter line cable features a core member of one or more strands of conductive material overlaid with a primary insulation layer containing ferrites and/or magnetites. This layer is then further overlaid with a flame-retardant insulation jacket layer made of high-temperature material. Both the primary insulation and the outer jacket layer are cross-linked.

US 2010/294531 discloses a motor vehicle power cable comprises at least one first flat-conductor element surrounded by at least one first insulation element. The motor vehicle power cable further comprises at least one second flat-conductor element surrounded by at least one second insulation element, and at least one shielding element surrounding the at least one first insulation element and the at least one second insulation element. In addition to this, the first flat-conductor element surrounded by the first insulation element and the second flat-conductor element surrounded by the second insulation element are arranged in such a way that wide surfaces of the flat-conductor elements lie on one another.

EP 1 453 068 discloses a flat conducing cable of longitudinal rectangular cross-section, consisting of two parallel surfaces along the longer of the rectangular sides and two along the shorter rectangular side, where one of the two surfaces has a covering shield consisting of a wire.

CN 202 720 954 is a utility model which discloses telephone system power supply cable with high anti-interference performance. The cable comprises a plurality of core wires twisted by a plurality of copper conductors. The plurality of core wires are disposed in a same plane and are arranged in parallel. The plurality of core wires are wrapped in a low-smoke halogen-free insulating layer with a rectangular cross section. An aluminum foil shielding layer with a rectangular cross section is wrapped round the external surface of the low-smoke halogen-free insulating layer. A copper-wire-woven shielding layer is wrapped round the external surface of the aluminum foil shielding layer. A sheath layer with a rectangular cross section is wrapped round the external surface of the copper-wire-woven shielding layer.

U.S. Pat. No. 4,383,225 discloses an electric cable comprising a plurality of separate screenings immunized against external parasites, particularly of high amplitude, wherein the screenings are separated by one or more insulating or slightly conducting magnetic layers, formed from magnetic compositions and applied by extrusion.

SUMMARY

The present inventors have found that eddy current losses may be further reduced than what is possible by means of the design disclosed in WO2012136754.

An object of the present disclosure is thus to provide a cable for a high voltage winding of an electromagnetic induction device, which cable reduces losses in the winding when in a loaded condition.

Hence, in a first aspect of the present disclosure, there is provided a cable for a high voltage winding of an electromagnetic induction device, comprising: a conductor having a width w, and a shield arranged around at least a portion of the conductor, wherein in any cross-section of the conductor the conductor has rounded corners with a radius r in the range $w/8<r\leq w/2$.

It has been realized by the inventors that eddy current losses are prevalent in the corners of a conductor of a cable for a winding. By rounding the corners of the conductor, these high-loss areas may be removed. The range of radius values $w/8<r\leq w/2$ includes the optimal radius range in view of a trade-off between providing tangible eddy current loss reduction while not increasing the DC loss too much. DC loss is a function that increases as the cross-sectional area of the conductor decreases.

The cable according to the present disclosure may be particularly advantageous for high voltage applications where high currents are present, thus resulting in high losses. It is to be noted, however, that the cable could also be used for medium voltage applications and even low voltage applications.

According to one embodiment the space formed outside any rounded corner is filled with a magnetic material. The magnetic material provides further reduction of eddy current losses in combination with the rounded corners of the conductor.

According to one embodiment the radius is in the range $w/6<r\leq w/2$.

According to one embodiment the radius is in the range $w/5<r\leq w/2$.

According to one embodiment the radius is in the range $w/5<r\leq w/3$. It has been found that the optimal radius reduction is somewhere in the above-indicated ranges, with regards to eddy current reduction, in case no area compensation of the conductor is provided in view of the reduced area obtained as a result of the rounded corners of the conductor.

According to one embodiment the magnetic material has a relative magnetic permeability $\mu r>1$.

According to one embodiment the magnetic material is a polymer magnet. In this case, the encapsulation surrounding the conductor and shield may be a polymer magnet, resulting in a simple manufacturing process since the encapsulation in this case has two functions; it fills the spaces obtained due to the rounded corners and acts as an encapsulation for the conductor.

According to one embodiment the magnetic material is a magnetic gel.

According to one embodiment the magnetic material comprises magnetic dust or glue mixed with epoxy.

According to one embodiment the magnetic material is a magnetic fluid.

There is according to a second aspect of the present disclosure provided a high voltage electromagnetic induction device comprising: a magnetic core having a limb, and a cable according to the first aspect presented herein, wherein the cable is wound around the limb, forming a high voltage winding.

According to one embodiment the high voltage electromagnetic induction device is a high voltage transformer or a high voltage reactor.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

The present disclosure relates to a cable for a high voltage winding of an electromagnetic induction device, such as a high voltage transformer or a high voltage reactor. The design of the cable reduces eddy current losses. Eddy current losses may be reduced by providing rounded corners in any cross-section of the cable. The rounded corners may have a radius in the range $w/8<r\leq w/2$, where w is the width of the conductor forming part of the cable. Typically all of the rounded corners have the same radius.

By rounding the cable corners, the cross-sectional area is decreased, resulting in higher DC losses if the radius of the rounded corners is too large. DC loss is a function of the cross-sectional area of a cable for a winding; the higher the cross-sectional area, the lower the DC loss.

According to one aspect disclosed herein, DC loss compensation for round-cornered conductors is provided by compensating, in the design phase, for any cross-sectional area reduction obtained due to rounding of the corners. DC loss compensation is obtained by, in the design phase, selecting larger conductor dimensions, in particular one of the height and width dimensions of the conductor, or both, with a corresponding amount that has been removed by the rounding of the corners or will be removed by rounding the corners. The cross-sectional area may thus in the design phase be selected so that it after having been provided with rounded corners corresponds to the cross-sectional area of a conductor which has rectangular corners. In this manner both reduced eddy current losses and maintained the DC loss may be provided.

Figure 1:
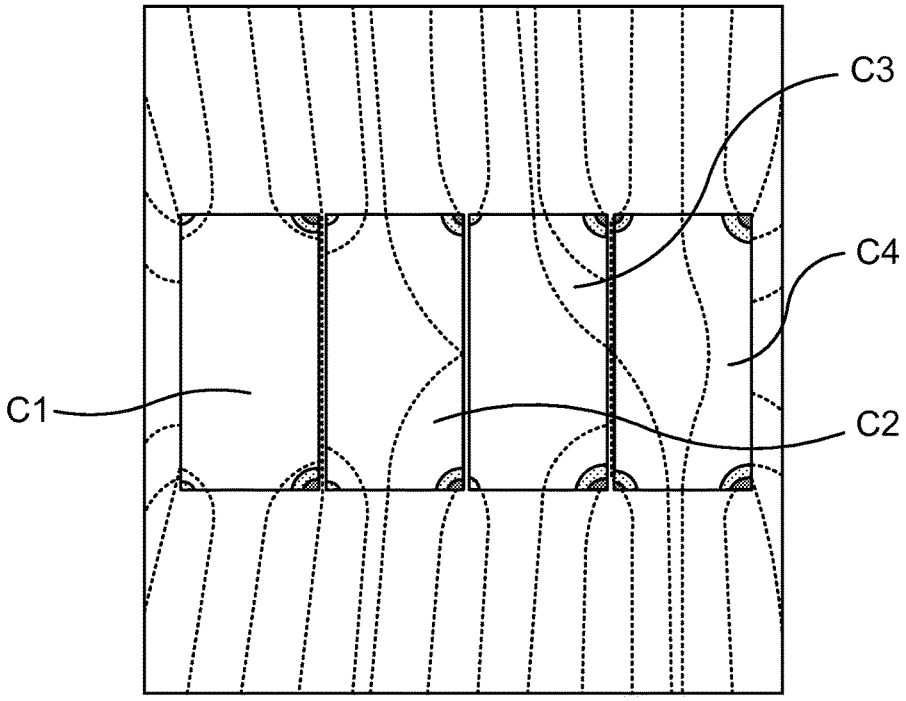
FIG. 1 shows eddy current losses for a prior art cable for a winding of an electromagnetic induction device.

FIG. 1 shows a computer simulation in which high currents flow through a plurality of conductors C1-C4 having a rectangular cross-section and forming part of a high voltage winding. As can be seen, there are high losses in the corners. These losses occur due to the induction of eddy currents by the leakage flux.

Figure 2:
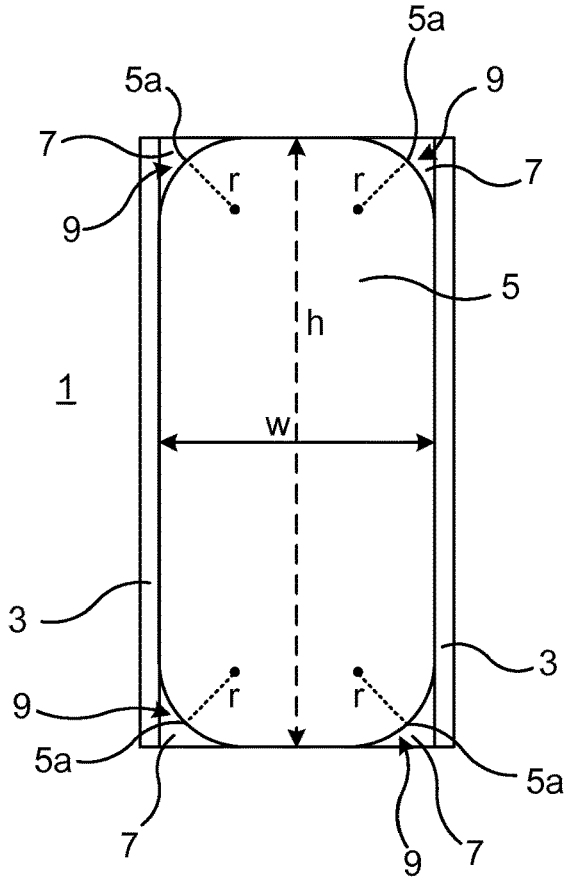
FIG. 2 shows a cross-section of an example of a cable for a winding of an electromagnetic induction device.
Figure 3:
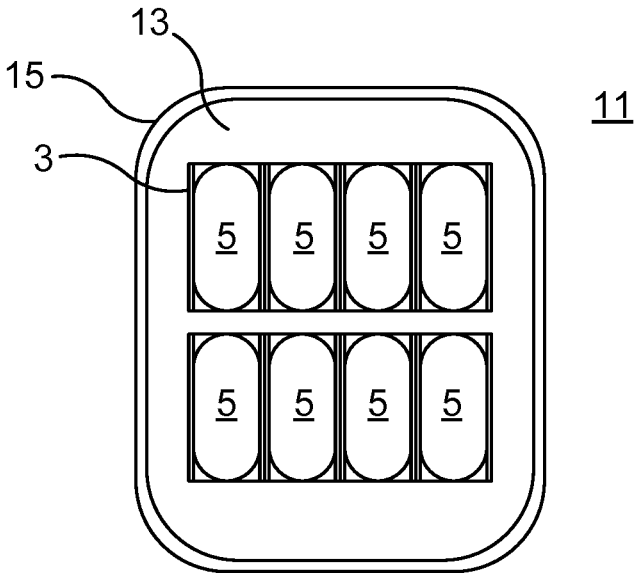
FIG. 3 depicts a cross-section of an example of cable for an electromagnetic induction device.

With reference to FIGS. 2 and 3 examples of a cable for a high voltage winding of an electromagnetic induction device will now be described.

FIG. 2 shows a cross-section of an example of a cable for a high voltage winding. The exemplified cable 1 comprises a shield 3, and a conductor 5.

The cable 1 may furthermore include an encapsulation configured to encapsulate the shield 3 and the conductor 5, and solid insulation, provided around the encapsulation. The encapsulation may for example comprise an epoxy and the solid insulation may for example comprise a cellulose-based material, such as paper.

The conductor 65 may for example be made of copper or aluminum. In cross-section, each corner 5*a* of the conductor 5 is rounded, having a radius r. The radius r of each corner 5*a* is in the range $w/8<r\leq w/2$. The radius r of each corner 5*a* may for example be in the range $w/6<r\leq w/2$, such as $w/5<r\leq w/2$, or $w/4\leq r\leq w/2$, or $w/4\leq r\leq w/3$.

According to the present example, the conductor 5 has a generally elongated cross-sectional shape. The cross-sectional shape is substantially rectangular, except for the corners 5*a*. The conductor 5 has a width w, which is defined as the distance between the long sides of the conductor 5. The conductor 5 also has a height h defined as the distance between the short sides. According to the present example the width w is smaller than the height h. The height h of the conductor 5 forms part of the height of one winding disc of a winding having been created by means of the cable 1. The width w of the conductor 5 forms part of the width of a winding turn of a winding having been created by means of the cable 1.

The shield 3 at least partly surrounds the conductor 5. The shield 3 is preferably arranged in the leakage flux direction, i.e. parallel with the leakage flux. This typically means that the shield 3 is arranged along a long side of the conductor 5. The shield 3 comprises a magnetic material. The shield 3 is configured to provide magnetic shielding of the conductor 5. The magnetic material of the shield 3 preferably has a relative magnetic permeability $\mu r$ in the range 2 to 100 000. The shield 3 may for example have a thickness which is at least 100 μm, preferably in the range 200 to 800 μm. Examples of suitable materials and suitable characteristics of the shield 3 are provided in WO2012136754.

According to the present example, the shield 3 is provided along both long sides of the conductor 5. The shield 3 could alternatively be provided around the entire conductor, or it could be provided along the short sides of the conductor, instead of the long sides, or along only one of the long sides or only along one of the short sides.

Since the corners 5*a* of the conductor 5 are rounded having a radius r, a space 7 is obtained outside each rounded corner 5*a*. According to one variation, this space 7 is filled with a magnetic material 9. The magnetic material 9 acts as a filler, filling space 7. The magnetic material 9 is preferably a "soft" magnetic material, by which are meant materials that are deformable, to easily obtain the shape of a space 7. The magnetic material 9 may be any soft magnetic material that has a relative magnetic permeability $\mu r$ greater than 1. The magnetic material may for example be a magnetic gel, or it may comprise magnetic dust or glue mixed with epoxy, or it may be a magnetic fluid such as a ferrofluid. The magnetic material 9 could also be a polymer magnet. Hereto, the encapsulation may according to one variation be a polymer magnet, which fills the spaces 7.

FIG. 3 shows a cross-section of another example of a cable for a winding. Cable 11 is a multi-strand cable and comprises a plurality of conductors 5 arranged in a plurality of rows. According to the present example the number of rows is two, but there could of course instead be more rows than two or less rows than two. Each conductor 5 forms a strand of the cable 11. Each conductor 5 is at least partly surrounded by a shield 3, and all of the conductors 5 have rounded corners, as described in FIG. 1. The cable 11 furthermore comprises an encapsulation 13, for example an epoxy encapsulation, enclosing the conductors 5, and solid insulation 15 enclosing the encapsulation 13.

Figure 4A:
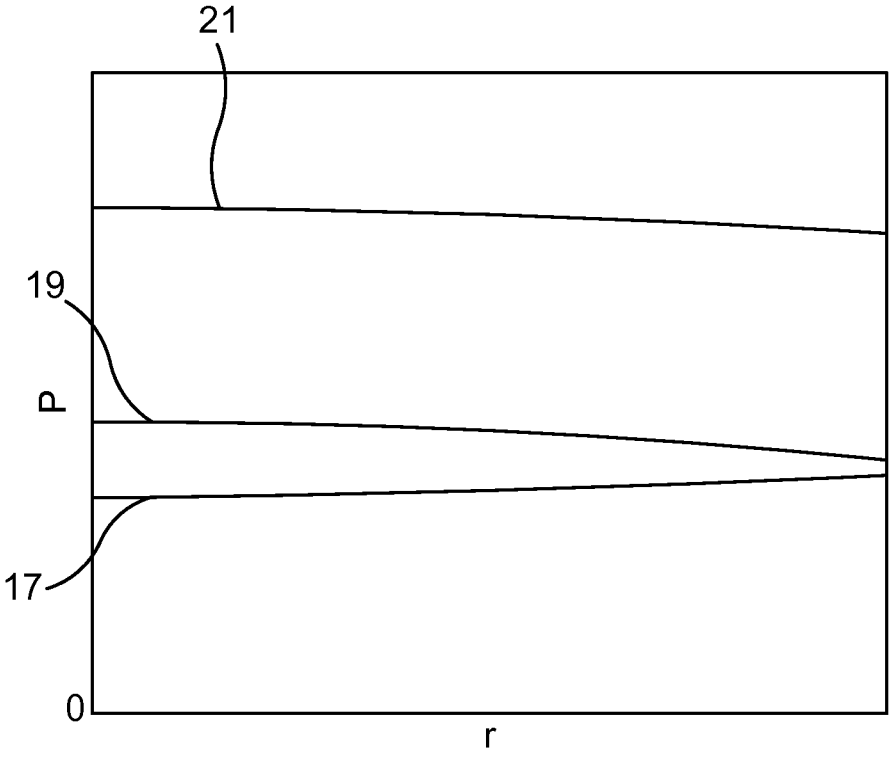
FIG. 4*a* shows a plot of the power loss in a cable for a winding of an electromagnetic induction device, which cable is without shield and without magnetic material acting as filler in the wedges, for different corner radii.

FIG. 4*a* shows a plot that illustrates the losses of a cable for a high voltage winding that has no shield and no magnetic material in the spaces 7. The x-axis shows different radii of the corners 5*a*, from essentially no radius at all at the origin, i.e. a rectangular-shaped conductor, to the maximum radius of half the width, and the y-axis shows the power loss as a function of the radius, from no power loss at all at the origin. Curve 17 shows the DC loss in the conductor. As expected, the DC loss increases with the increase in radius r, since the total cross-sectional area of conductor decreases as the corners are made more and more round. Curve 19 shows the eddy current loss, which decreases as the radius r increases. Curve 21 shows the total loss, i.e. both eddy current losses and DC losses. The total loss is slightly reduced as the corner radius of the conductor is increased, even for the maximum radius, although the DC loss slightly offsets the efficiency provided by the rounded corners.

Figure 4B:
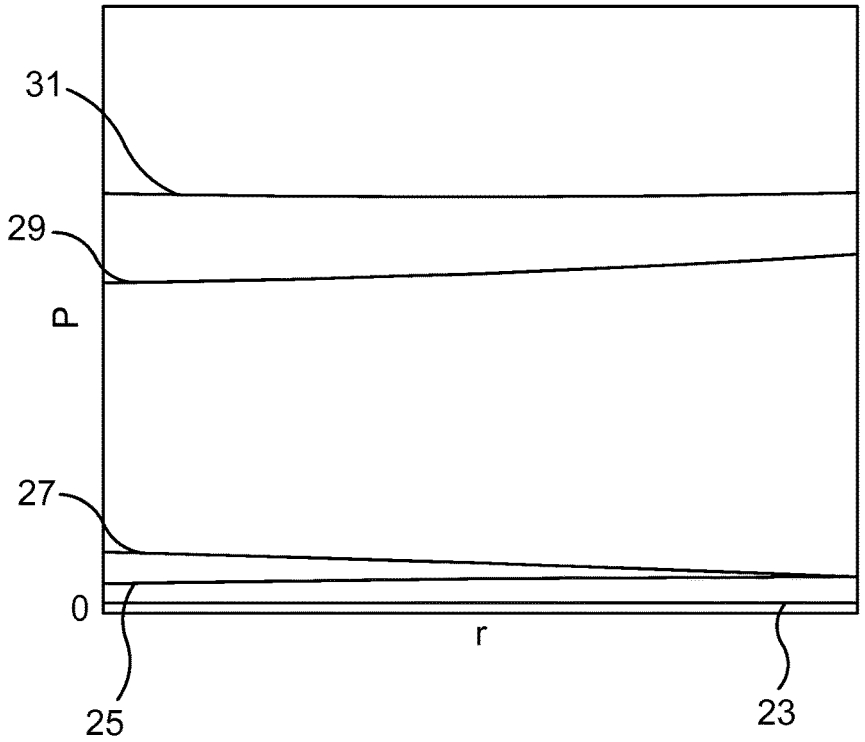
FIG. 4*b* shows a plot of the power loss in a cable for a winding of an electromagnetic induction device, which cable includes a shield but is without magnetic material acting as filler in the wedges, for different corner radii.

FIG. 4*b* shows a plot that illustrates the losses of a cable for a high voltage winding that has a shield 3 but no magnetic material in the spaces 7. The x-axis and the y-axis describe the same parameters as indicated in the previous example. Curve 23 shows eddy current losses in the shield, and curve 25 shows hysteresis losses in the shield, both of which are constant with respect to changes in the radius r of the corners 5*a*. Curve 27 shows the eddy current loss in the conductor, which again decreases as the radius increases. Curve 29 shows the DC loss in the conductor, which increases with the radius r. Curve 31 shows the total loss, which decreases as the radius increases. The combination of shield and curved radius however provides a much smaller total loss than in the case shown in FIG. 4*b*; in the present example, the total loss for any radius is about half of the total loss in the example of FIG. 4*a*.

Figure 4C:
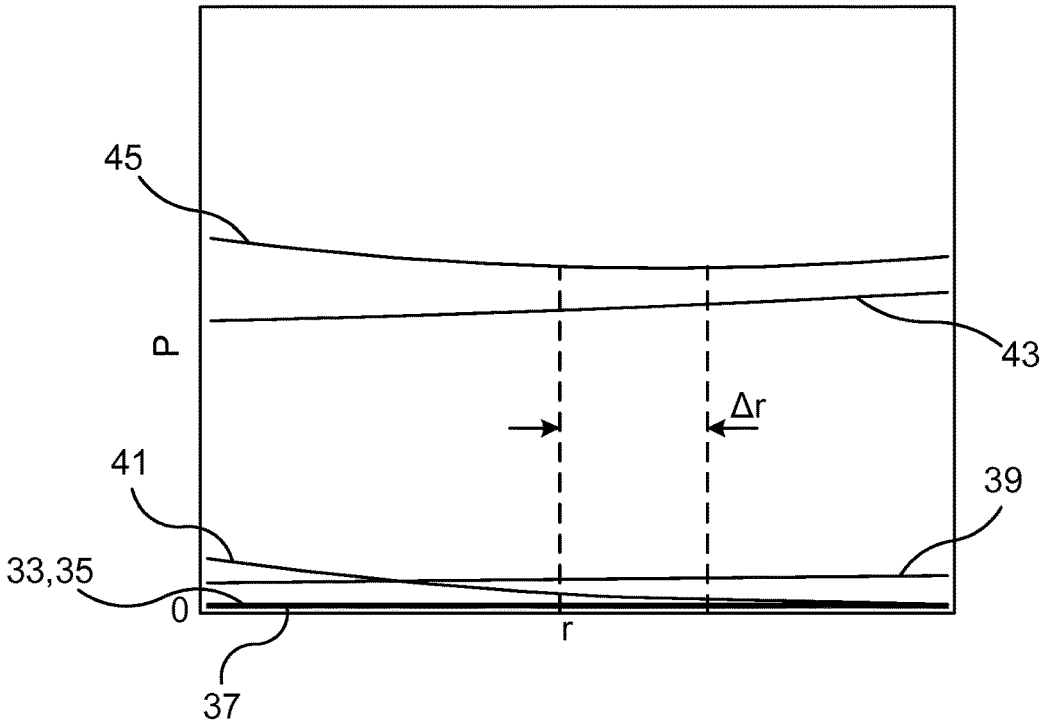
FIG. 4*c* shows a plot of the power loss in a cable for a winding of an electromagnetic induction device, which cable includes a shield and magnetic material acting as filler in the wedges, for different corner radii.

FIG. 4*c* shows a plot that illustrates the losses of a cable for a high voltage winding that has a shield 3 and magnetic material in the spaces 7. The x-axis and the y-axis describe the same parameters as indicated in the two previous examples. Curves 33 and 35 show the eddy current losses and the hysteresis losses in the magnetic material, i.e. the filler material, respectively. Curve 37 shows the eddy current loss in the shield, and curve 39 shows the hysteresis loss of the shield in this case. Curve 41 shows the eddy current loss in the conductor, which again decreases with an increased radius. Curve 43 is the DC loss in the conductor, and curve 45 is the total loss. Again, the total loss decreases as the radius r of the corners of the conductor increases. However, with both the magnetic material acting as fillers in the spaces 7 and the shield 13 arranged at least partly around the conductor 5, the total loss has a minimum which is substantially smaller than in the case shown in FIG. 4*b*. This minimum is located in a radius range $\Delta r$, which corresponds to about w/5 to about w/3 of the conductor 5, i.e., between about one fifth of the width w of the conductor 5 to a width w of about one third of the conductor 5.

The area reduction of the conductor 5 obtained when providing the conductor with rounded corners during manufacturing may be compensated for. The area reduction may be compensated for by using conductor material which has a slightly larger cross-sectional area than what is desired for DC loss purposes, prior to the rounding of the corners. If for example the rounding of the corners reduces the total cross-sectional area by say 3%, one could start with a conductor that has a cross-sectional area of about 103.1% of the desired cross-sectional area. When the corners are rounded, 100% of the desired cross-sectional area will be obtained.

Figure 5:
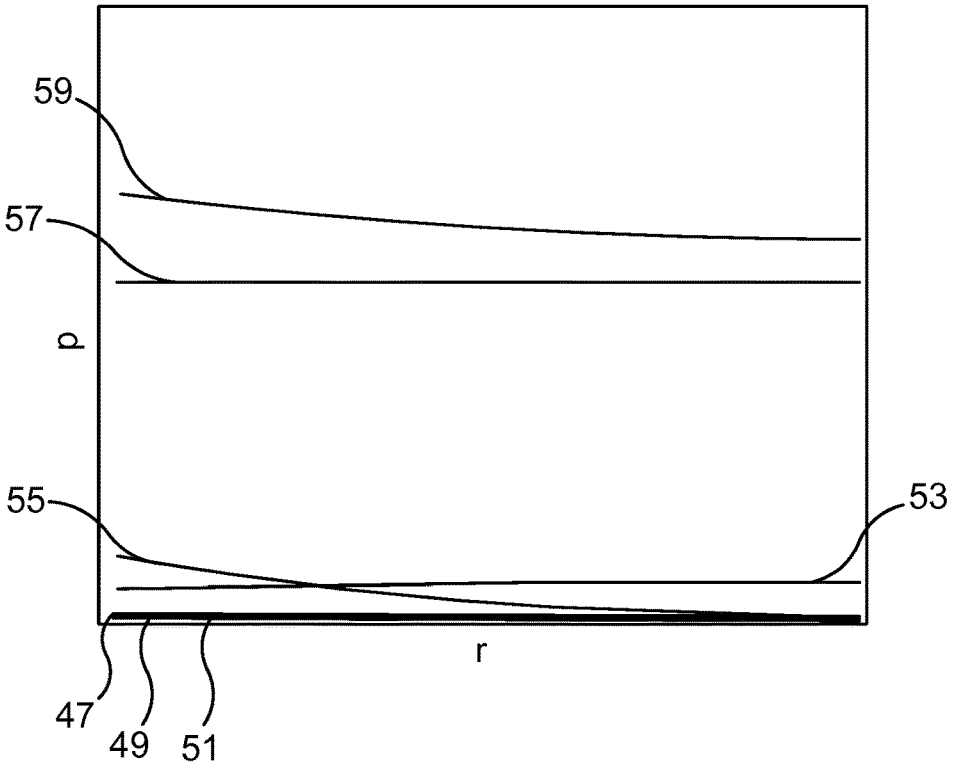
FIG. 5 is a plot of the power loss in a cable for a winding of an electromagnetic induction device under the same premises as in FIG. 4*c* however with area compensation.

FIG. 5 shows a plot that illustrates the losses of a cable for a high voltage winding that has a shield 3 and magnetic material in the spaces 7, with area compensation of the conductor during production thereof. The x-axis and the y-axis describe the same parameters as indicated in the previous examples. Curves 47 and 49 show the eddy current losses and the hysteresis losses in the magnetic material, i.e. the filler material, respectively. Curve 51 shows the eddy current loss in the shield, and curve 53 shows the hysteresis loss in the shield in this case. Curve 55 shows the eddy current loss in the conductor, which again decreases with an increased radius. Curve 57 shows the DC loss in the conductor, which in the area-compensated case is constant for any radius r. It does not increase with increased an increased radius, like in the non-compensated case shown in FIG. 4*c*. The total loss shown by curve 59 will therefore be lower for larger radii than in the case without area compensation shown in FIG. 4*c*.

Figure 6:
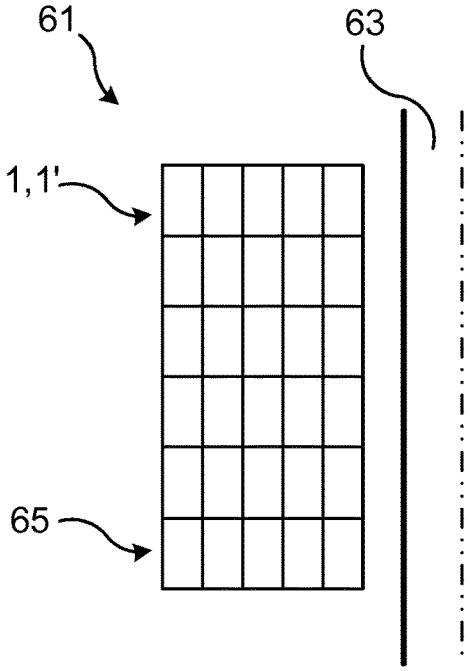
FIG. 6 is a sectional view of a portion of a high voltage electromagnetic induction device comprising a winding having been made of a cable shown in FIG. 2 or 3.

FIG. 6 shows a portion of a high voltage electromagnetic induction device 61 comprising a magnetic core 63 made of e.g. a plurality of laminated sheets of steel, and a high voltage winding 65. The magnetic core 63 has a limb around which the high voltage winding 65 is wound. The high voltage winding 65 comprises a plurality of turns and windings discs, and comprises a cable with rounded corners of the type disclosed herein. The high voltage winding 65 may hence comprise a cable such as cable 1 or cable 11.

The cable disclosed herein is adapted for being used to construct a high voltage winding of a high voltage electromagnetic induction device, where eddy current losses are non-negligible. Such an electromagnetic induction device may for instance be a transformer such as a power transformer, an HVDC transformer, a reactor or a generator. Hereto, the cable may advantageously be used for high voltage applications.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A cable for a high voltage winding of an electromagnetic induction device, comprising:

a conductor having a width w, and a shield arranged around at least a portion of the conductor, wherein in any cross-section of the conductor the conductor has rounded corners with a radius r in the range $w/5<r<w/3$, wherein a space between the conductor and the shield is defined at the rounded corners, wherein the shield is in contact with an outer surface of the conductor, and wherein the outer surface of the conductor is between the rounded corners.

2. The cable as claimed in claim 1, wherein the magnetic material is a polymer magnet.

3. The cable as claimed in claim 1, wherein the outer surface comprises a first sidewall and a second sidewall that is spaced apart from the first sidewall by the width w, wherein the rounded corners comprise at least four rounded corners, wherein the space between the conductor and the shield includes a plurality of spaces that are arranged at the at least four corners, and wherein the first sidewall is between a first two of the at least four corners and the second sidewall is between a second two of the at least four corners that is different from the first two of the at least four corners.

4. The cable as claimed in claim 1, wherein the space formed outside any rounded corner is filled with a magnetic material.

5. The cable as claimed in claim 4, wherein the magnetic material has a relative magnetic permeability $\mu r>1$.

6. The cable as claimed in claim 4, wherein the magnetic material is a magnetic gel.

7. The cable as claimed in claim 4, wherein the magnetic material comprises magnetic dust or glue mixed with epoxy.

8. The cable as claimed in claim 4, wherein the magnetic material is a magnetic fluid.

9. A high voltage electromagnetic induction device comprising:

a magnetic core having a limb, and a cable including:

a conductor having a width w, the cross-sectional shape of the conductor being rectangular except for the corners, wherein the width w is defined as the distance between the long sides of the conductor, and a shield arranged along at least one of the sides of the conductor, wherein in any cross-section of the conductor the conductor has rounded corners with a radius r in the range $w/5<r\leq w/3$, wherein the cable is wound around the limb, forming a high voltage winding, and wherein a space between the conductor and the shield is defined at the rounded corners, wherein the shield is in contact with an outer surface of the conductor, and wherein the outer surface of the conductor is between the rounded corners.

10. The high voltage electromagnetic induction device as claimed in claim 9, wherein the high voltage electromagnetic induction device is a high voltage transformer or a high voltage reactor.

11. The high voltage electromagnetic induction device as claimed in claim 9, wherein a space between the conductor and the shield is defined at the rounded corners, wherein the space formed outside any rounded corner is filled with a magnetic material and wherein the magnetic material is a polymer magnet.

12. The high voltage electromagnetic induction device as claimed in claim 9, wherein a space between the conductor and the shield is defined at the rounded corners, wherein the space formed outside any rounded corner is filled with a magnetic material, and wherein the magnetic material is a magnetic gel.

13. The high voltage electromagnetic induction device as claimed in claim 9, wherein a space between the conductor and the shield is defined at the rounded corners, and wherein the magnetic material comprises magnetic dust or glue mixed with epoxy.

14. The high voltage electromagnetic induction device as claimed in claim 9, wherein a space between the conductor and the shield is defined at the rounded corners, wherein the space formed outside any rounded corner is filled with a magnetic material, and wherein the magnetic material is a magnetic fluid.

15. The high voltage electromagnetic induction device as claimed in claim 9, wherein the outer surface comprises a first sidewall and a second sidewall that is spaced apart from the first sidewall by the width w, and wherein the shield contacts the first and second sidewalls between the spaces.

16. The high voltage electromagnetic induction device as claimed in claim 9, wherein the space formed outside any rounded corner is filled with a magnetic material.

17. The high voltage electromagnetic induction device as claimed in claim 16, wherein the magnetic material has a relative magnetic permeability $\mu r>1$.

18. The high voltage electromagnetic induction device as claimed in claim 16, wherein the magnetic material is a polymer magnet.

19. The high voltage electromagnetic induction device as claimed in claim 16, wherein the magnetic material is a magnetic gel.

20. The high voltage electromagnetic induction device as claimed in claim 16, wherein the magnetic material comprises magnetic dust or glue mixed with epoxy.

* * * * *